US005303928A

United States Patent [19]

Scuderi

[11] Patent Number: 5,303,928

[45] Date of Patent: Apr. 19, 1994

[54] WINDSURFING BOARD GAME

[76] Inventor: Paul Scuderi, 111-½ North Park St., Merrill, Wis. 54452

[21] Appl. No.: 42,043

[22] Filed: Mar. 31, 1993

[51] Int. Cl.[5] ..... A63F 3/00

[52] U.S. Cl. ..... 273/249; 273/252; 273/254

[58] Field of Search ..... 273/242, 243, 248, 249, 273/246, 251, 252, 254, 281

[56] References Cited

U.S. PATENT DOCUMENTS

| | | | |
|---|---|---|---|
| 1,165,688 | 12/1915 | Maris . | |
| 1,656,943 | 1/1928 | Firestone . | |
| 2,211,297 | 8/1940 | Bull | 273/252 |
| 2,585,268 | 2/1952 | Olsen . | |
| 2,635,881 | 4/1953 | Cooney | 273/254 X |
| 2,757,933 | 8/1956 | Gilmour | 273/254 |
| 3,232,620 | 2/1966 | Schoolcraft et al. . | |
| 3,874,671 | 4/1975 | Smith | 273/254 |
| 3,921,981 | 11/1975 | Ashburn . | |
| 3,942,800 | 3/1976 | Holbrook | 273/254 X |
| 4,003,578 | 1/1977 | Jones . | |
| 4,093,235 | 6/1978 | Barry | 273/254 |
| 4,097,051 | 6/1978 | Goldberg et al. | 273/254 |
| 4,120,503 | 10/1978 | Macrory et al. . | |
| 4,828,268 | 5/1989 | Somerville . | |
| 4,850,597 | 7/1989 | Milliken | 273/254 |

FOREIGN PATENT DOCUMENTS

| | | | |
|---|---|---|---|
| 220795 | 8/1957 | Australia | 273/252 |
| 2196862 | 5/1988 | United Kingdom | 273/252 |
| 8705527 | 9/1987 | World Int. Prop. O. | 273/252 |

*Primary Examiner*—William Stoll

[57] ABSTRACT

A windsurfing board game includes a game board divided into a shore area, a water area and an island area. The water area and island areas are divided into playing spaces, and playing pieces in the form of windsurfers are moved on the playing spaces according to the roll of a die. A treasure indicia is hidden on the island spaces. The players move from the water area to the island area in an effort to uncover the treasure indicia by exposing the undersurface of the island space landed upon. Once the treasure indicia is located, the player returns back to the shore area from the island through the water area. Chance cards are employed during movement through the water area with each turn, with each chance card containing either a favorable, adverse or neutralizing indicia.

4 Claims, 3 Drawing Sheets

FIG. 3
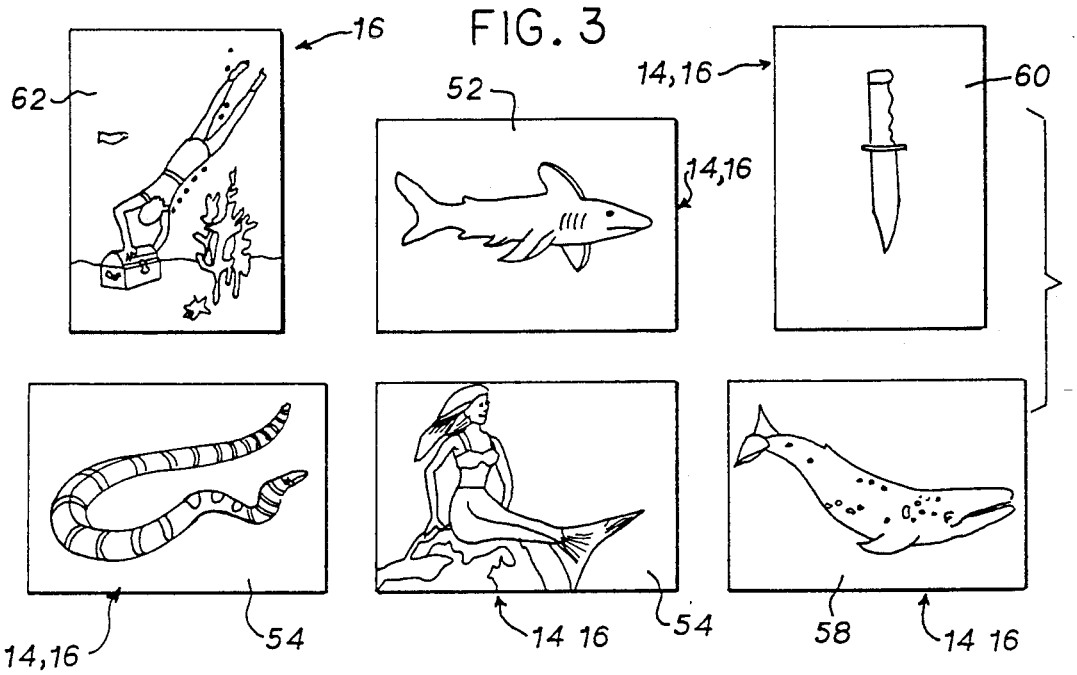
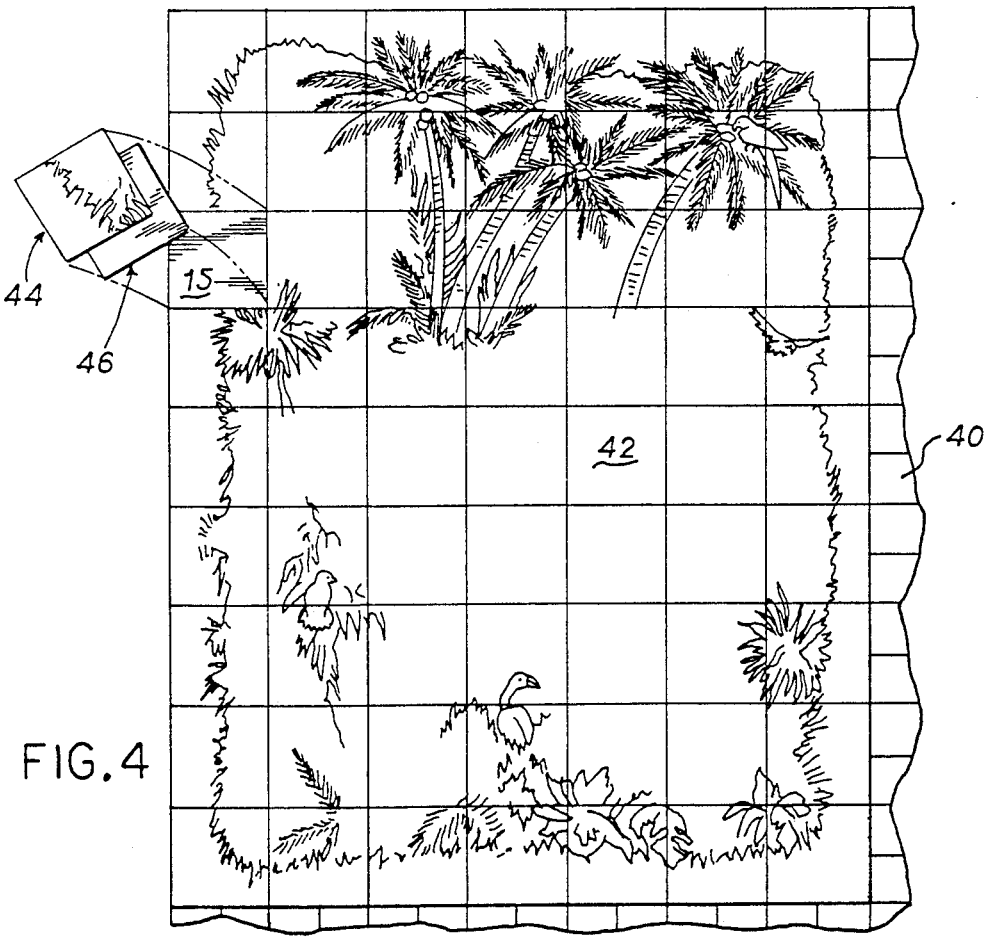
FIG. 4

WINDSURFING BOARD GAME

BACKGROUND AND SUMMARY

This invention relates to games, and more particularly to a board-type game.

In accordance with the game of the invention, a board game apparatus generally consists of a game board having a shore area, a water area, and an island area. At least the water area is divided into a series of contiguous playing spaces. A series of island playing spaces, resembling a puzzle, are removably mountable to the island area of the game board, with each island space defining a top surface and an undersurface. A treasure indicia is provided on the undersurface of one of the island spaces. A series of playing members or pieces are provided for movement on the game board. The playing members are preferably representative of windsurfers. The board game apparatus of the invention further includes a die for use in advancing the playing members on the game board, and at least one set of chance cards. Each set of chance cards includes one or more favorable chance cards favorably affecting a player's progress in the game and one or more adverse chance cards adversely affecting the player's progress in the game. Each player employs the die to move a playing member on the game board from the shore area to the water area playing spaces, toward the island area. A chance card is drawn for each roll of the die while the player is on the water area playing spaces. Once a player reaches the island area, the player searches for the island space containing the treasure indicia, by rolling the die and exposing the undersurface of the island playing space landed upon. When a player lands upon the island playing space carrying the treasure indicia on its undersurface, the player takes possession of the treasure indicia space and leaves the island area. The player then returns to the shore area by rolling the die to advance the playing member through the water area playing spaces.

In accordance with other aspects of the game of the invention, a path arrangement is provided in the water area of the game board for defining a path which must be followed by the playing members during movement through the water area playing spaces. In addition, each island playing space is defined by first and second island space members. The first island space member defines the undersurface of the island playing space, and the second island space member overlies the first island space member and defines the top surface of the island playing space. The second island space members are located on the island area of the game board in predetermined positions, and the positions of the first island space members are changed from game to game, to vary the location of the treasure indicia for each game. In addition to the treasure indicia, adverse indicia are provided on the undersurface of others of the island playing spaces for adversely affecting a player's progress on the island during the search for the treasure indicia. The board game apparatus of the invention preferably contemplates two sets of chance cards. A first set of chance cards is used when the player is advancing from the shore area to the island area, and a second set is used when the player is returning from the island area back to the shore area. The second set of chance cards includes one or more dive cards which cause the player in possession of the treasure indicia to lose one or more turns. This provides an opportunity for the remaining players to attempt to catch the player possessing the treasure indicia, thereby setting the stage for a battle to determine which player takes or retains possession of the treasure indicia. Each set of chance cards further includes one or more neutralizing cards which are retained by the players, for offsetting the adverse affect of the one or more adverse chance cards.

The invention further contemplates a method of playing a board game, substantially in accordance with the foregoing summary.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings:

FIG. 3 is a view showing representative adverse, favorable and neutralizing indicia carried by the indicia-carrying surfaces of the chance cards in the first and second sets of chance cards;

FIG. 4 is an enlarged partial plan view showing the island area of the game board of FIG. 1;

DETAILED DESCRIPTION OF THE INVENTION

Figure 1:
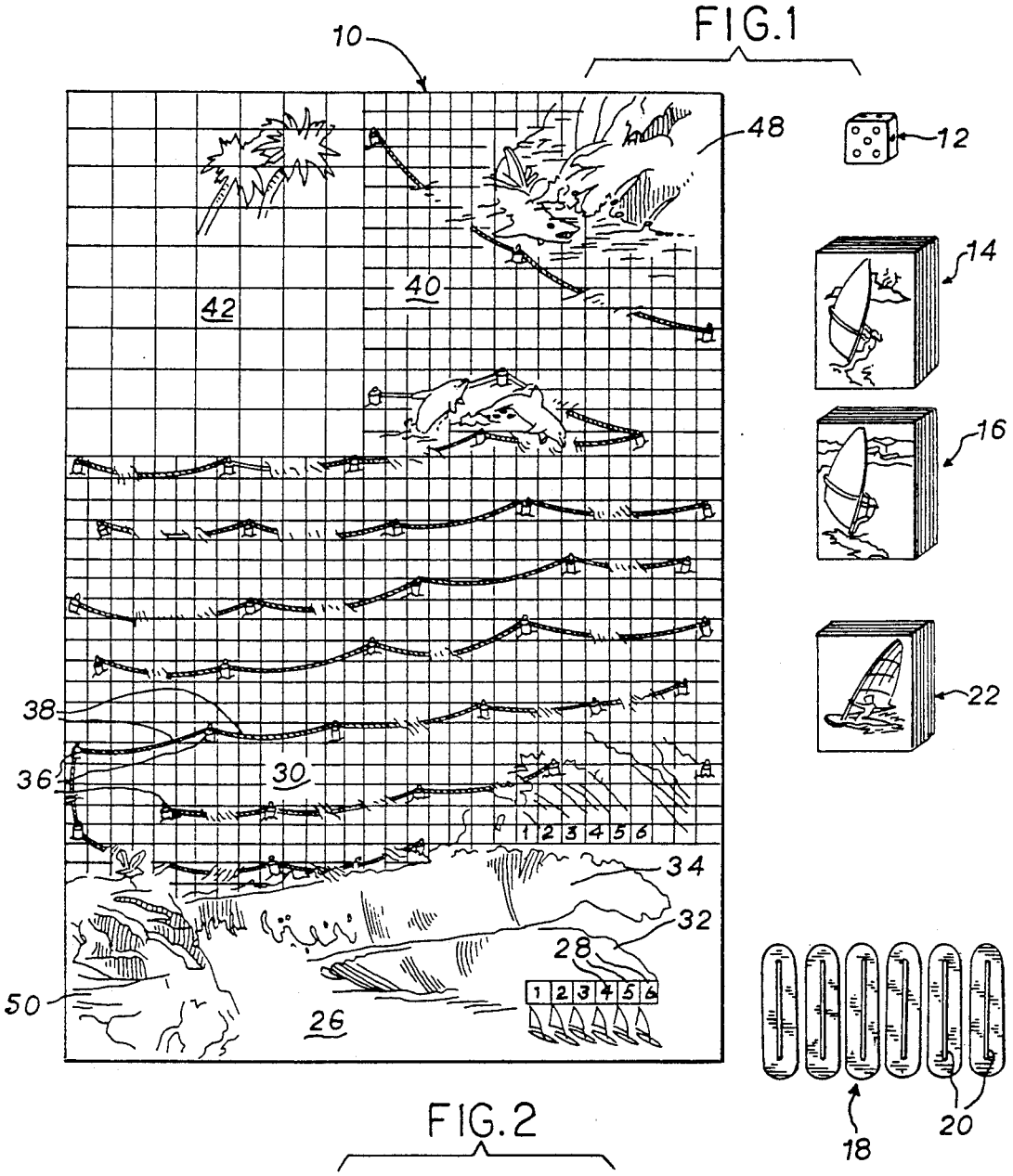
FIG. 1 is a view illustrating the various components of the game apparatus of the invention, including the game board, the die, the first and second sets of chance cards and the windsurfer playing members.

FIG. 1 generally illustrates the components of the game board apparatus of the invention, which include a game board 10, a die 12, a first set or deck of island chance cards 14, a second set or deck of shore chance cards 16, and a series of windsurfer playing members. Each windsurfer playing member is constructed from one of a series of bases 18, each of which defines a slot 20, and a pair of mirror-image windsurfer illustrations contained on opposite side surfaces of cards 22. Each card in set 22 contains an illustration of a windsurfer in a color distinct from that in the remaining cards. Each card is selected from set 22 and placed into a slot 20 in one of bases 18, to construct a playing member or piece.

As shown in FIG. 1, game board 10 includes a shore area 26 having a series of contiguous numbered starting spaces 28, and a water area 30 including numbered starting spaces immediately above and numbered correspondingly to numbered starting spaces 28. Water area 30 contains grid marks which divide water area 30 into individual playing spaces. First and second waves 32, 34 are illustrated on game board 10, between starting spaces 28 and water area 30.

A series of buoys 36 interconnected by ropes 38 are illustrated on water area 30, defining a zig-zag path within water area 30 leading to an entrance area 40 which abuts an island area 42 provided in the upper left corner of game board 10.

Referring to FIG. 4, island area 42 is divided into a number of contiguous island spaces, each of which is defined by an upper island space member such as 44, and a lower island space member such as 46. Each upper island space member 44 overlies a lower island space member 46, with space members 44, 46 defining intermediate facing surfaces which contact each other when members 44, 46 are placed into position on island area 42. The underside of space member 46 contacts the upwardly facing surface of game board 10, and the upper surface of space member 44 is illustrated to depict a portion of an island scene. The upper surface of game board 10 at island area 42 is illustrated with an island scene and divided into a grid corresponding to the arrangement of island space members 44, 46 when assembled into the island scene. Each space defined by the grid on the upper surface of game board 10 is numbered, with space number 15 being exposed in FIG. 4. A surface, such as the underside, of each upper island space member 44 is similarly numbered, to assist in locating upper island space members 44 on the grid defining island area 42.

As illustrated in FIG. 1, game board 10 further contains an island rock area 48 located in the upper right hand corner, and a shore rock area 50 in the lower left hand corner. Island chance cards 14 are placed onto island rock area 48, and shore chance cards 16 are placed onto shore rock area 50. Island chance cards 14 are used during movement of the playing pieces toward island area 42, and shore chance cards 16 are used when the playing pieces are returning from island area 42 back to shore area 26.

Figure 2:
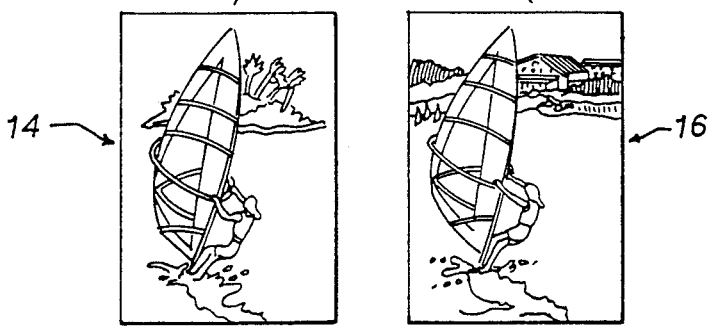
FIG. 2 is a view showing the illustrations provided on the outer surfaces of the chance cards in the first and second sets of chance cards.

FIG. 2 illustrates the scenes depicted on the outer surfaces of each of chance cards 14, 16. Each island chance card 14 contains an illustration of a windsurfer enroute to an island. Each shore chance card 16 contains an illustration of a windsurfer traveling toward a shore area including a beach house or the like.

FIG. 3 depicts representative illustrations which are provided on the surfaces of cards 14, 16 opposite the outer surfaces illustrated in FIG. 2. Generally, the illustrations in FIG. 3 can be divided into three categories: 1) favorable card illustrations which favorably affect a player's progress in water area 30; 2) adverse card illustrations which adversely affect the player's progress in water area 30; and 3) neutralizing card illustrations which offset the adverse affect of the adverse cards. Representative adverse cards are illustrated at 52, 54. Adverse card 52 depicts an illustration of a shark, such as a tiger shark. Adverse card 54 contains an illustration of a beaked sea snake. As will be explained, adverse cards such as 52, 54 cause a player to move backward in water area 30 or to lose a turn, when drawn from the set of cards. Representative favorable cards are illustrated at 56, 58. Favorable card 56 contains an illustration of a mermaid, and favorable card 58 contains an illustration of a blue whale. As will be explained, cards 56, 58 allow a player to advance a certain number of spaces in water area 30 when drawn by a player. A neutralizing card is shown at 60, containing an illustration of a knife. Knife card 60 is retained by the player when drawn, and is used to "kill" sharks or sea snakes, such as illustrated on cards 52, 54.

The adverse, favorable and neutralizing cards illustrated at 52–60 are contained in each of decks of cards 14, 16, along with other cards carrying illustrations of different adverse and favorable sea creatures. Representatively, the deck of island cards 14 and the deck of shore cards 16 each include the following cards:

| No. of Cards | Illustration |
|---|---|
| | Adverse Cards |
| 3 | White shark |
| 3 | Hammerhead shark |
| 3 | Tiger shark |
| 4 | Blue shark |
| 4 | Black tip reef shark |
| 5 | Beaked sea snake |
| 7 | Yellow lipped sea krait or sea snake |
| | Favorable Cards |
| 6 | Seal |
| 3 | Mermaid |
| 5 | Blue whale |
| 5 | Sperm whale |
| 5 | Bowhead whale |
| 5 | Southern right whale |
| 15 | Dolphin |
| | Neutralizing Cards |
| 35 | Knife |

In addition to the above, the deck of shore cards 16 also includes twenty dive cards, shown in FIG. 3 at 62. In a manner as will be explained, dive card 62, when drawn by the player in possession of the treasure indicia space, causes the player to lose turns, allowing other players to catch up with the player possessing the treasure indicia space.

Figure 5:
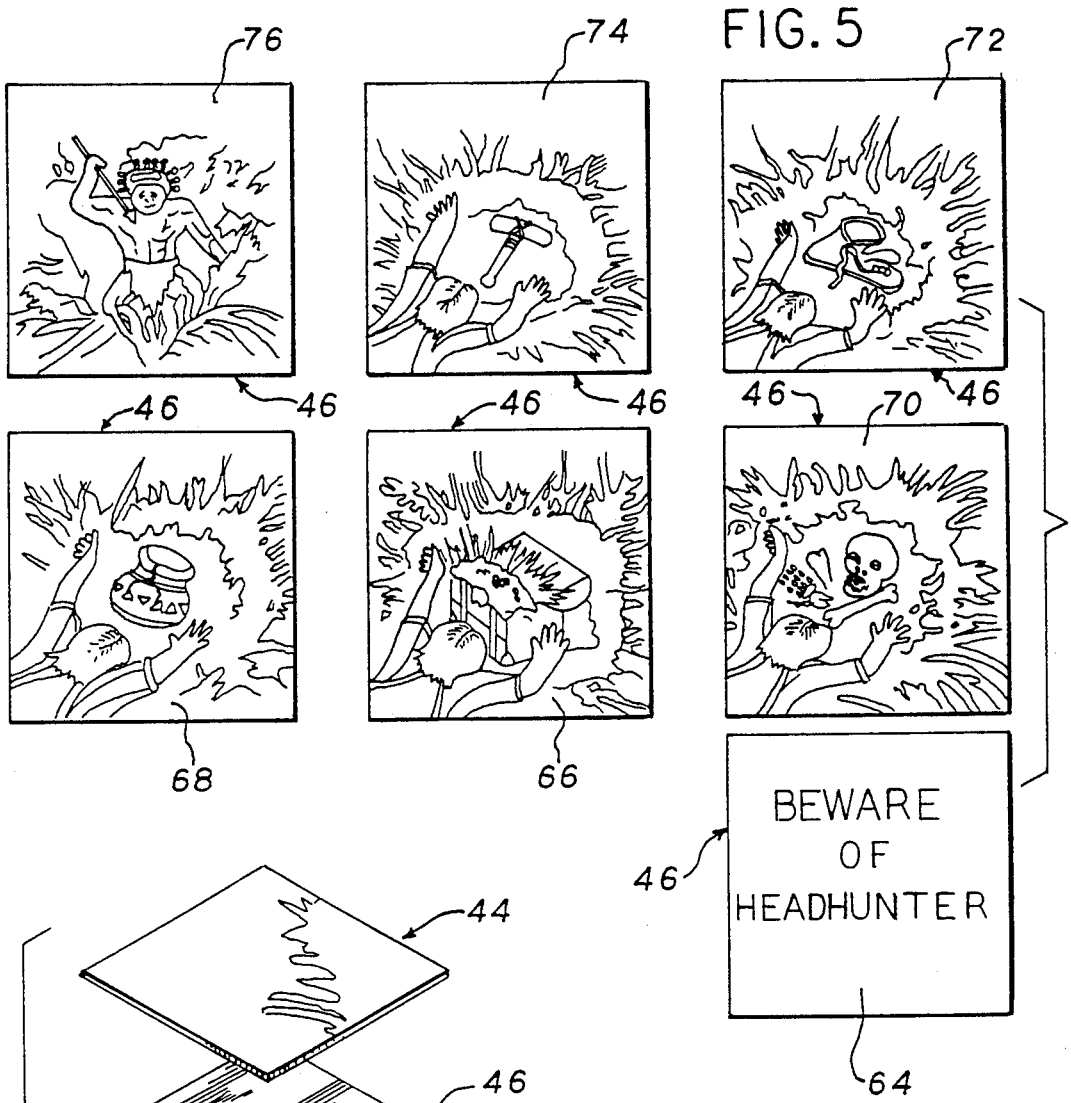
FIG. 5 is a view showing the indicia provided on the undersurfaces of certain of the island playing spaces.

Referring to FIG. 5, the undersurface defined by each lower island space member 46 contains one of the indicia or illustrations shown in FIG. 5. Representatively, island area 42 is shown broken into a grid of 63 spaces. The undersides of 57 of the lower island space members 46 are provided with the legend BEWARE OF HEAD HUNTER, shown at 64. One of lower island space members 46 is provided with a treasure indicia 66, in the form of an illustration of a person uncovering a buried treasure. The remaining five lower island space members 46 are provided with the following: a pottery crock illustration 68, a skull and bones illustration 70, a boot illustration 72, a hammer illustration 74, and a head hunter illustration 76. As will be explained, illustrations 68–76 are adverse, with each causing a player to lose one or more turns as the player moves on island area 42.

Figure 6:
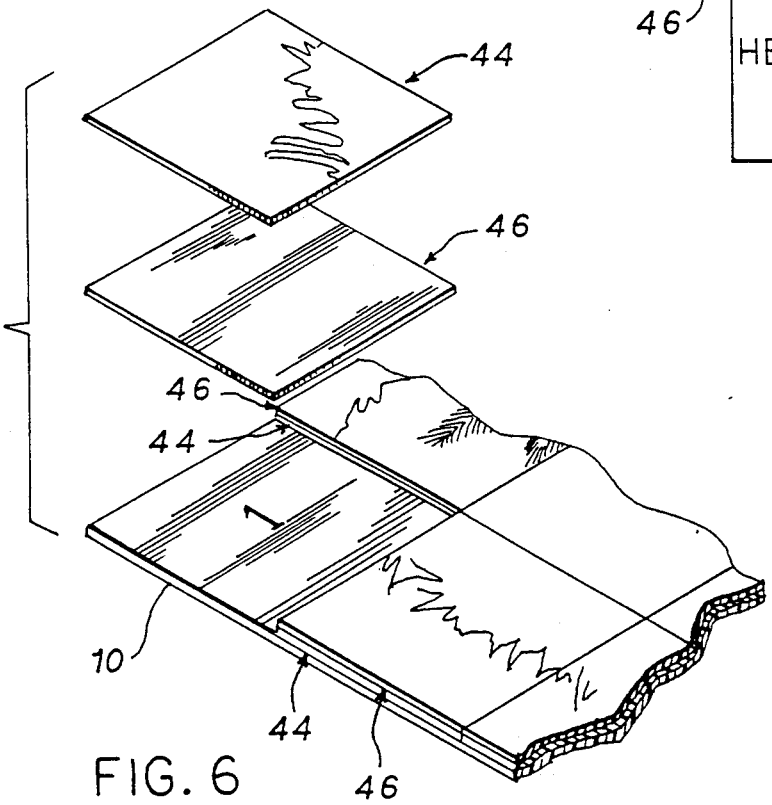
FIG. 6 is an exploded isometric view showing the relationship of the first and second island space members prior to placement on the island area of the game board.

FIG. 6 illustrates in greater detail the manner in which upper and lower island space members 44, 46 are mounted to island area 42 of game board 10, showing space number one in the island area grid being exposed. The undersurface of each lower island space member 46 is placed on the island grid space, and the upper island space member having the number corresponding to the island grid space is placed over the lower island space member 46. Upper island space members 44 each contain a portion of an island illustration, such as containing representations of palm trees and other island flora and fauna.

The rules in play of the game apparatus illustrated in FIGS. 1–6 will now be explained.

OBJECT

The object of the game of the invention is to be the first player to travel from shore area 26 through water area 30 to island area 42, locate the island playing space containing the treasure illustration 66, and return from island area 42 through water area 30 to shore area 26.

SET UP

Prior to commencing play, each player first assembles a windsurfer game piece using one each of like-colored windsurfer cards 22, and placing the like-colored cards into slot 20 associated with one of windsurfer bases 18. The players then place all lower island space member 46 on the upper surface of game board 10, with the legends and illustrations shown in FIG. 5 facing down so as not to be visible to the players. Lower island space members 46 are then mixed around on game board 10, and then placed onto the spaces defined by the grid of island area 42. Upper island space members 44 are then placed over lower island space members 46. As noted previously, each upper island space member 44 is numbered correspondingly to the numbers of the spaces defined by the island grid, to assemble the island illustration. In this manner, the locations of the various illustrations of FIG. 5 contained on the undersurfaces of lower island space members 46 are unknown to the players.

In addition, the deck of island cards 14 is shuffled and placed onto island rock area 48 of game board 10. The deck of shore cards 16 is shuffled and placed onto shore rock area 50 of game board 10.

PLAYING THE GAME

The players roll die 12 to determine which player goes first, with the player rolling the highest number going first. To negotiate wave 32, each player must roll a 1 or a 6 on die 12, and the player then places his playing piece directly above his starting space 28 between waves 32, 34. If unsuccessful, play passes to subsequent players, and each player continues until he successfully rolls a 1 or a 6. Once the player successfully negotiates wave 32, the player must roll a 2 or a 6 on die 12 to pass wave 34, in the same manner as described previously. Once the player successfully rolls a 2 or a 6 to negotiate wave 34, the player places his playing piece on the numbered space corresponding to his starting space 28 directly above wave 34. The player is then within water area 30 of game board 10.

Once the player reaches water area 30, he rolls die 12 to advance his playing piece along the path defined by buoys 36 and ropes 38 through water area 30 in an effort to reach island area 42. During movement on water area 30 toward island 42, each player draws one of island cards 14 on each turn. The player either follows the directions on the card drawn or saves the card. Cards not saved are returned to the bottom of the set of island cards 14.

Adverse cards contained within island cards 14, such as shark card 52 and sea snake card 54, their adverse impact on the player's progress, and the manner in which the adverse impact can be offset, are as follows:

| Card | Adverse Impact | Offset By |
|---|---|---|
| White shark | 10 spaces back and loss of turn | 3 knife cards and 2 dolphin cards, or 5 knife cards, or 3 dolphin cards |
| Hammerhead shark | 6 spaces back and loss of turn | 3 knife cards and 1 dolphin card, or 4 knife cards, or 2 dolphin cards |

-continued

| Card | Adverse Impact | Offset By |
|---|---|---|
| Tiger shark | 4 spaces back and loss of turn | 2 knife cards and 1 dolphin card, or 3 knife cards, or 2 dolphin cards |
| Blue shark | 6 spaces back | 2 knife cards, or 1 dolphin card |
| Black tip reef shark | 6 spaces back | 2 knife cards, or 1 dolphin card |
| Beaked sea snake | loss of turn | 3 knife cards |
| Yellow lipped sea krait | 3 spaces back | 2 knife cards |

The favorable cards contained within island cards 14, such as mermaid card 56 and blue whale card 58, and their favorable impact on the player's progress, are as follows:

| Favorable Card | Favorable Impact |
|---|---|
| Mermaid | Advance 10 spaces |
| Dolphin | Advance 6 spaces or, if saved, used for killing sharks |
| Seal | Advance 5 spaces |
| Blue whale | Advance 4 spaces |
| Sperm whale | Advance 4 spaces |
| Bowhead whale | Advance 4 spaces |
| Southern right whale | Advance 4 spaces |

As noted previously, knife cards 60 are saved and used to offset the adverse impact of the adverse cards in island and shore cards 14, 16, and do not advance the player directly when drawn. Dolphin cards can be used either to advance the player or, if saved, can be used to offset the adverse impact of the adverse cards.

During movement on water area 30 toward island area 42, two players cannot occupy the same space, and each player must move all spaces for each roll of die 12 and for each card drawn. This forces players to not always take the shortest tack available.

In a situation where a player is just past wave 34 and is instructed to move backward by one of island cards 14 a certain number of spaces, the player simply returns to the nearest space on water area 30 adjacent wave 34.

The players then advance through water area 30 to entrance area 40, and onto island area 42. Once on island area 42, the players attempt to locate the lower island space member 46 containing treasure illustration 66 by continued rolling of die 12 and moving on island area 42 corresponding to the number rolled. Each time the player lands on one of the island spaces, the player turns over upper and lower island space members 44, 46 to expose the undersurface of the island space landed upon. When a player lands on the island space containing treasure illustration 66, hereafter referred to as the treasure space, the player maintains possession of the treasure space. When a player lands on any other island space, the lower island space member is turned over to expose its undersurface, and then removed from board 10. When a player uncovers one of illustrations 68–76 (FIG. 5), the player's progress on island space 42 is adversely impacted as follows:

| Island Space Illustration | Adverse Impact |
|---|---|
| Head Hunter (2 cards) | loss of 3 turns |
| Skull and bones | loss of 2 turns |

-continued

| Island Space Illustration | Adverse Impact |
|---|---|
| Pottery crock | loss of 1 turn |
| Boot | loss of 1 turn |
| Hammer | loss of 1 turn |

During play on the island, the players do not draw any cards from island cards 14 or shore cards 16.

After one of the players locates and takes possession of the treasure space, the player leaves island area 42 by continued rolling of die 12, and returns to water area 30. Once the player enters water area 30, the player draws a card from shore cards 16 for each turn. As noted previously, in addition to the same card illustrations contained in island cards 14, shore cards 16 include twenty dive cards 62. The cards other than dive cards 62 are saved or played in the same manner described previously. If a card directs a player to move backward and such a move would result in landing on an island space, the player only returns to the nearest water space in contact with island spaces 42.

During movement of the player possessing the treasure space back toward shore area 26, the remaining players attempt to catch the former player by landing on the same space occupied thereby. However, each player must first reach island area 42 before attempting to catch the player in possession of the treasure space. If a challenging player lands on the same space occupied by the player possessing the treasure space the two players engage in a "battle", to be explained, to determine which player takes or retains possession of the treasure space.

When the player possessing the treasure space draws a dive card 62, that player losses two turns. This presents an opportunity for other players to catch up with the player possessing the treasure space 66. Each of the other players rolls die 12, attempting to land on the same space occupied by the player possessing the treasure space.

When a challenging player lands on the space occupied by the player possessing the treasure space, the challenging player does not draw a shore card 16 for that turn; rather, the two players "do battle" by rolling die 12 to determine which player takes or retains possession of the treasure space. The player currently in possession of the treasure space rolls first, and the challenging player rolls second. The player rolling the highest number on die 12 takes possession of the treasure space. If the players roll the same number, they continue to roll die 12 until one or the other gains control. The player who wins the battle takes possession of the treasure space, rolls die 12 again, and moves on water area 30 accordingly, drawing the top card from island cards 16. The player losing the battle loses his next turn. Play then continues, with the players not in possession of the treasure space attempting to land on the space occupied by the playing piece of the player possessing the treasure space in an effort to engage in battle to gain control of treasure space 66.

The player possessing the treasure space continues movement on water area 30 through the path defined by buoys 36 and ropes 38, in an effort to return with the treasure back to shore area 26.

If no player lands on the same space occupied by the player in possession of the treasure space during the loss of turns caused by the latter player drawing the dive card, the player regains possession of the treasure.

If a battle occurs while the players are located on one of the numbered starting water area spaces, the player losing the battle must move back 7 spaces, in order to relieve congestion in the numbered water area starting spaces.

When the player possessing the treasure space approaches shore area 26, the player must roll a 2 or a 6 on die 12 to advance past wave 34. If successful, the player places his playing piece anywhere between wave 34 and wave 32. The player then draws a card from shore cards 16, but the player cannot go forward or backward if so directed by the card drawn. However, the treasure may still be lost by the player either drawing dive card 62 or by doing battle. If the treasure space is lost between wave 34 and wave 32, the player who next gains control of the treasure space is declared the winner of the game. If only one player is between wave 34 and wave 32 and that player has possession of the treasure space, he must roll a 1 or a 6 on die 12 to advance past wave 32 onto shore area 26. That player is then declared the winner of the game.

In two-player games, there is a possibility that a stalemate may occur during movement on water area 30 by both players drawing a card directing each player to loss one or more turn. When this occurs, play automati7 cally passes to the player having the next turn. In addi7 tion, the players may wish to eliminate certain of island upper and lower space members 44, 46 in a two-player game in order to advance the players' progress in locating treasure space 66. For instance, the outermost island space members 44, 46 can be discarded, resulting in a reduction in the number of island space members from 63 to 48.

Also in a two-player game, it may be desirable to make it easier for the player possessing treasure space 66 to advance past waves 32, 34. The players may then adopt a rule allowing the player to pass wave 34 by rolling a 2 or a 6 on die 12, as set forth previously, or by drawing a whale card from shore cards 16. Similarly, the player can pass wave 32 by rolling a 1 or a 6 on die 12, as set forth previously, or by drawing a dolphin shore card 16.

Various alternatives and embodiments are contemplated as being within the scope of the following claims particularly pointing out and distinctly claiming the subject matter regarded as the invention.

I claim:

1. A method of playing a board game, comprising the steps of:

providing a game set including:

a game board having a shore area, a water area, and an island area, at least the water area being divided into a plurality of playing spaces;

a plurality of island cards defining playing spaces removably mountable on the island area of the game board, each island card defining a top surface and an undersurface;

a treasure indicia provided on the undersurface of one of the island cards;

a plurality of playing members representative of windsurfers;

a die; and at least one set of chance cards including one or more favorable chance cards favorably affecting a player's progress in the game and one or more adverse chance cards adversely affecting a player's progress in the game;

utilizing the die to advance a playing member on the water area playing spaces toward the island area, and then on the island cards to locate the treasure indicia by exposing the undersurface of each island playing space landed upon by the playing member, and then returning from the island area through the water area playing spaces back toward the shore area; and utilizing the chance cards along with the die to control the progress of the playing member during movement of the playing member from the shore area toward the island area and from the island area toward the shore area.

2. The method of claim 1, wherein the at least one set of chance cards includes first and second sets of chance cards, the first set being used when the playing member is advancing from the shore area to the island area and the second set being used when the playing member is returning from the island area back to the shore area, wherein the second set of chance cards includes one or more cards causing the player in possession of the treasure indicia to lose one or more turns.

3. The method of claim 2, wherein, when the player in possession of the treasure card is caused to lose one or more turns, the remaining players attempt to take control of the treasure indicia by landing on the playing space occupied by the playing member of the player in possession of the treasure card.

4. The method of claim 3, wherein, when one of the remaining players lands on the playing space occupied by the playing member of the player in possession of the treasure card, the players roll the die to determine which player takes or retains possession of the treasure card.

* * * * *

UNITED STATES PATENT AND TRADEMARK OFFICE

CERTIFICATE OF CORRECTION

PATENT NO. : 5,303,928
DATED : April 19, 1994
INVENTOR(S) : Paul R. Scuderi

It is certified that error appears in the above-indentified patent and that said Letters Patent is hereby corrected as shown below:

Title page, item [76], inventor: after "Paul" insert -- R. --;

Column 9, claim 1, line 5, delete "playing space" and insert -- card --.

Signed and Sealed this

Twentieth Day of September, 1994

Bruce Lehman

*Attest:*

BRUCE LEHMAN

*Attesting Officer*

*Commissioner of Patents and Trademarks*